United States Patent [19]

Berstein et al.

[11] 4,167,106

[45] Sep. 11, 1979

[54] METHOD AND APPARATUS FOR FINISH ROLLING WORKPIECES OF SUBSTANTIALLY CIRCULAR CROSS-SECTION TO A SELECTED DIAMETER

[75] Inventors: Garrj Berstein, Erkelenz; Hans J. Naumann, Wassenberg, both of Fed. Rep. of Germany

[73] Assignee: Wilhelm Hegenscheidt GmbH, Erkelenz, Fed. Rep. of Germany

[21] Appl. No.: 869,248

[22] Filed: Jan. 13, 1978

[30] Foreign Application Priority Data

Jan. 15, 1977 [DE] Fed. Rep. of Germany ..... 2701593

[51] Int. Cl.[2] ..... B21H 1/00

[52] U.S. Cl. ..... 72/21; 72/35; 72/107; 72/108; 72/110

[58] Field of Search ..... 72/35, 21, 107, 108, 72/110; 51/165.87, 165.88; 33/125 M, 141 B, 182

[56] References Cited

U.S. PATENT DOCUMENTS

| | | | |
|---|---|---|---|
| 2,748,634 | 6/1956 | Koehring et al. | 72/107 |
| 3,358,485 | 12/1967 | DeCaro et al. | 72/35 |
| 3,992,910 | 11/1976 | Connell et al. | 72/110 |
| 4,044,580 | 8/1977 | Worden et al. | 33/182 |

*Primary Examiner*—Lowell A. Larson
*Attorney, Agent, or Firm*—Michael J. Striker

[57] ABSTRACT

A method for finish rolling workpieces of substantially circular cross-section to a selected diameter, in which the workpiece is engaged at circumferentially spaced portions by two rolls, at least one of which is driven for rotation about its axis, and in which at least one of the rolls is moved towards the other, until the portions of the rolls engaging the workpiece have reached a predetermined distance from each other in accordance with the selected diameter of the workpiece, and in which reaching of the predetermined distance is determined by measuring the distance of the peripheral surfaces of the rolls at selected points spaced from the portions thereof engaging the workpiece, and an apparatus for carrying out the method.

10 Claims, 5 Drawing Figures

METHOD AND APPARATUS FOR FINISH ROLLING WORKPIECES OF SUBSTANTIALLY CIRCULAR CROSS-SECTION TO A SELECTED DIAMETER

BACKGROUND OF THE INVENTION

The present invention relates to a method and apparatus for finish rolling workpieces of substantially circular cross-section to a selected diameter.

The possibility of finish rolling workpieces to a selected diameter have already been described in a thesis of Peter Kron (Technical College Braunschweig) with the title "The Finish Rolling of Cylindrical Workpieces by Rolls Movable Toward Each Other". On page 94 of this thesis in paragraph 8.2.1 three possibilities of finish rolling of a workpiece to a selected diameter and the preconditions therefor are mentioned, and the obtainable results described. The best results are obtained during finish rolling with an indicating control (FIG. 44). The indicating control relates to the control of the rolling force $P_w$. If the force $P_w$ reaches a predetermined size, the rolling process is finished.

This method has the disadvantage that desired results can be repeated only with varying rolling times. Therefore, this method is unsuitable for mass production, due to the varying rolling time per workpiece. Furthermore, with this method it is not possible to obtain during changing operating conditions a constant workpiece tolerance, since the spatial position of the apparatus elements and the elastic behavior of the latter change during changing of the temperature, which will entail a corresponding change in the workpiece tolerance. It is also not possible by increasing the rolling time to reach, for the workpieces of a series always the same force $P_w$ required by Kron. Depending on the material structure of a workpiece and the starting tolerance, it is not possible, even by increasing the rolling time, to obtain always the same force $P_w$ required by Kron.

According to another, in the aforementioned thesis described rolling method, the working rolls are moved towards each other until a predetermined desired value is reached. The reaching of this desired value is thereby determined by contact of the working rolls, respectively of elements connected thereto, with adjustable stops.

The adjustment, respectively the determination of such a desired value causes considerable difficulties since the bending of the rolls, the bearing trunions thereof, compression of bearing parts, as well as distorsion of the roll stand, etc. add up to an error in the position of the roll surfaces in the working region which can be hardly calculated. Since a direct measurement at the contact points between working rolls and workpiece is not possible, this measurement has to be carried out at the edge of the peripheral surface of the rolls, or in the region of the bearing trunions thereof, so that deviations from the desired value cannot be ascertained.

SUMMARY OF THE INVENTION

It is an object of the present invention to provide a method and apparatus for finish rolling of workpieces of substantially circular cross-section to a selected diameter, which avoids the disadvantages of such methods and apparatus known in the art.

With these and other objects in view, which will become apparent as the description proceeds, the method according to the present invention for finish rolling workpieces of substantially circular cross-section to a selected diameter mainly comprises the step of engaging circumferentially spaced portions of the workpiece by rolls rotatable about their axes, driving at least one of said rolls for rotation about its axis, moving at least one of the rolls toward the other until the portions of the rolls engaging the workpiece have reached a predetermined distance from each other in accordance with the selected finished diameter of the workpiece and determining reaching of this predetermined distance by measuring the distance of the peripheral surfaces of the rolls at selected points in the working region of the rolls, spaced from the portions of the roll engaging the workpiece.

According to a further feature of the present invention the rolls are moved with a speed not greater than 0.1 millimeter per revolution of the workpiece toward each other.

It is further proposed according to the present invention that, after reaching the desired distance between the peripheral surfaces of the rolls, the rolls are initially moved away from each other with a speed not greater than 0.1 millimeter per revolution of the workpiece. Thereby, the movement of the rolls may be carried out with varying speeds. For instance the advancing speed of the rolls may be retarded up to a minimum value or the return movement thereof be accelerated.

It is further suggested that the rolls, after reaching the desired distance from each other, be held in this position for the duration of at least one revolution of the workpiece.

The present invention relates also to an apparatus for carrying out the above-mentioned method, which is characterized in that the measuring device for establishing when the desired distance of the rolls from each other is reached is connected to switch means in such a manner that after the desired distance is reached the rolls are moved away from each other.

In addition, the measuring device may be connected to means for regulating the speed at which the rolls move away from each other.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
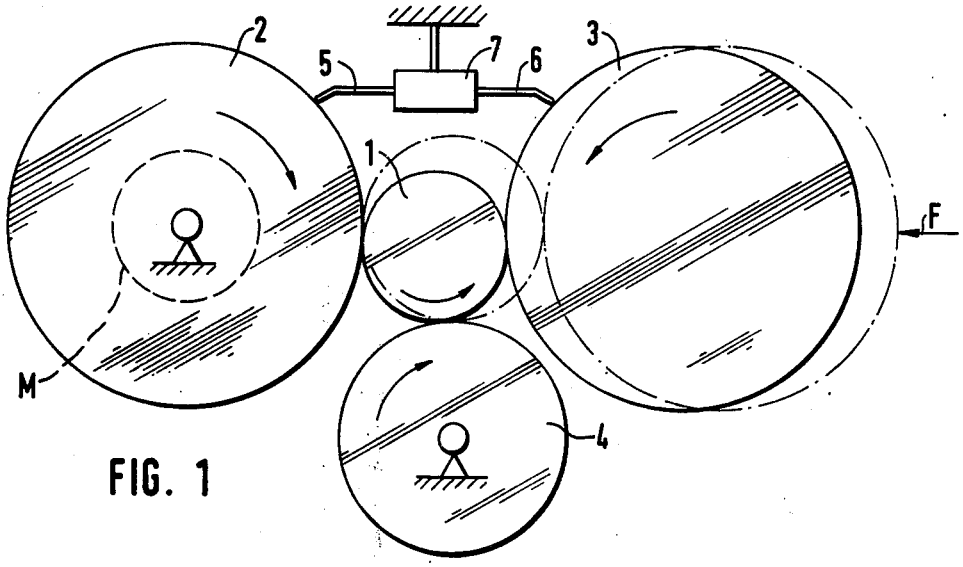
FIG. 1 schematically illustrates the apparatus according to the present invention, including two working rolls and a supporting roll.
Figure 3:
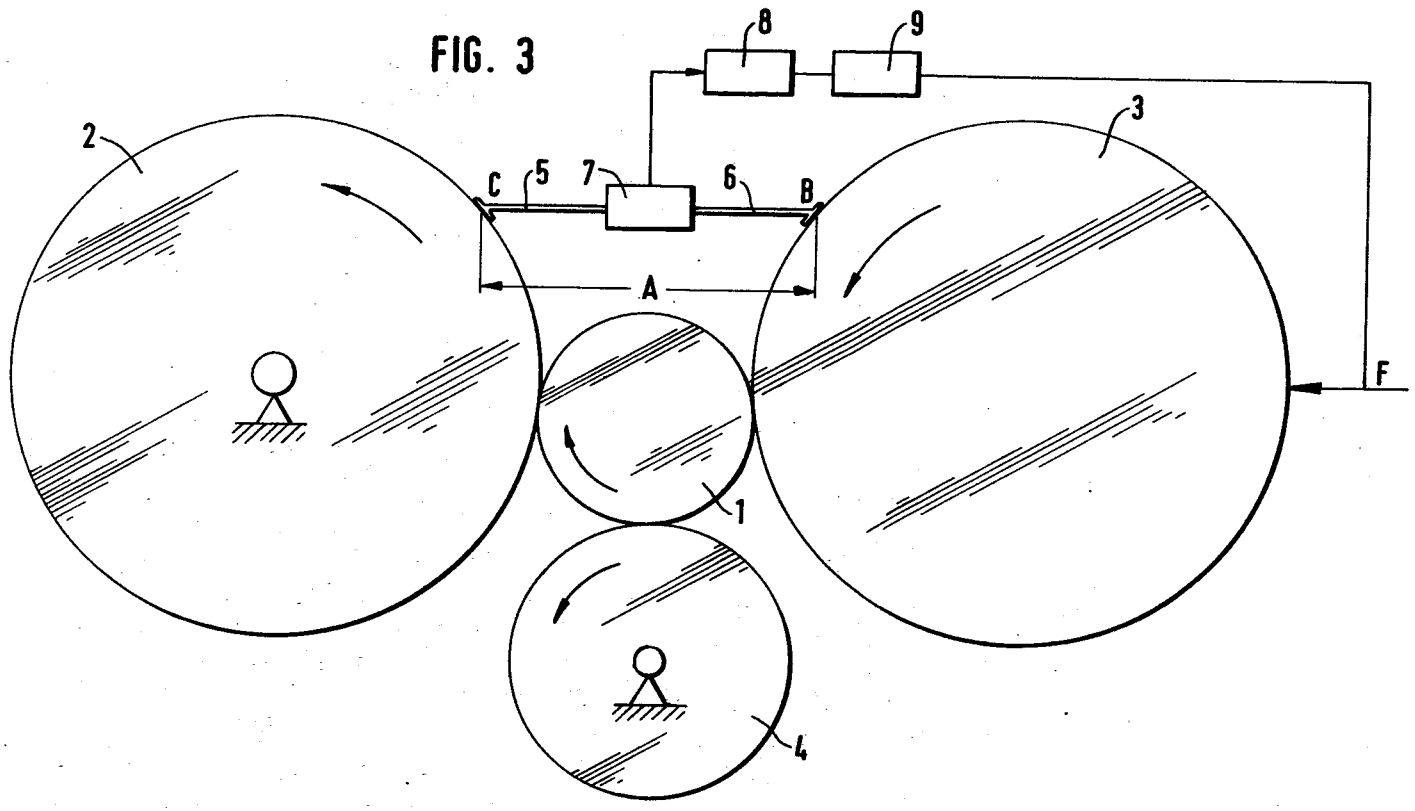
FIG. 3 schematically illustrates the arrangement as shown in FIG. 1, with the measuring device in operating position.
Figure 5:
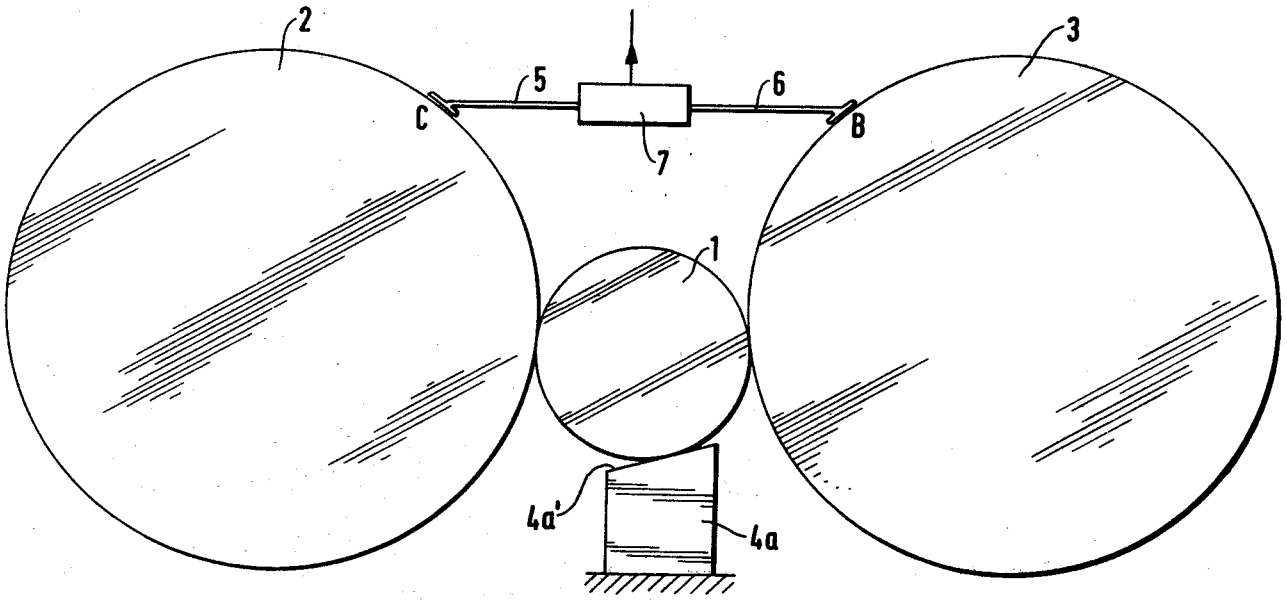
FIG. 5 schematically illustrates an arrangement with two working rolls and a stationary support for the workpiece.

In the embodiments illustrated in FIGS. 1, 3 and 5, the workpiece 1 rests on a supporting roll 4, respectively on an inclined surface 4*a*′ of a stationary supporting member 4*a* and is located between a working roll 2, mounted for rotation about a fixed axis, and a working roll 3, which is rotatable about an axis movable toward the axis of the fixed working roll 2, so as to press the workpiece against the peripheral surface of the roll 2. The drive for rotating the workpiece and the rolls about their axes in the manner as indicated by the arrows in FIG. 1 may be connected with one or a plurality of the rolls or to the workpiece itself, and such a drive is schematically indicated in FIG. 1 by a motor M connected in any manner, not shown in the drawing, preferably over a non-illustrated gear reduction, to the roll 2. The means for moving the movable roll 3 toward the roll 2 are also schematically indicated in FIG. 1 by the arrow F and such moving means preferably act on the peripheral surface of the roll 3. Such moving means are well-known in the art and are therefore not further described. In FIG. 1 the initial position of the movable roll 3 and the initial diameter of the workpiece 1 are shown in dotted lines, whereas the final position of the movable roll 3 and the workpiece 1 rolled down to its final diameter are illustrated in full lines. For clarity sake the difference between the initial diameter of the workpiece 1 and its final diameter is shown in FIG. 1 in an exaggerated manner. Of course, instead of moving only the roll 3 toward the roll 2, it is also possible to move both rolls simultaneously toward each other during finish rolling of the workpiece.

In order to determine the diameter of the finish rolled workpiece, two points B and C are selected on the working rolls 2 and 3, the distance of which has to be measured. These points are defined as being located in a plane having a definite position with respect to a plane including the axis of the rolls 2 and 3 and are further located on the peripheral surface, respectively on locations equivalent thereto, of the respective roll and that the line connecting these two points has a definite non-variable direction.

After placing the workpiece 1 between the rolls, the feelers 5 and 6 of a measuring device 7 are engaged with the points B and C, as shown in FIG. 3. Thereby a distance A is measured of which it is known that it is greater by a predetermined fixed amount than the distance of the engaging points of the rolls 2 and 3 with the workpiece 1 and the actual diameter of the workpiece can thus be calculated from the measured distance A and evidently the final selected diameter to which the workpiece has to be finished rolled can thus be established.

Figure 4:
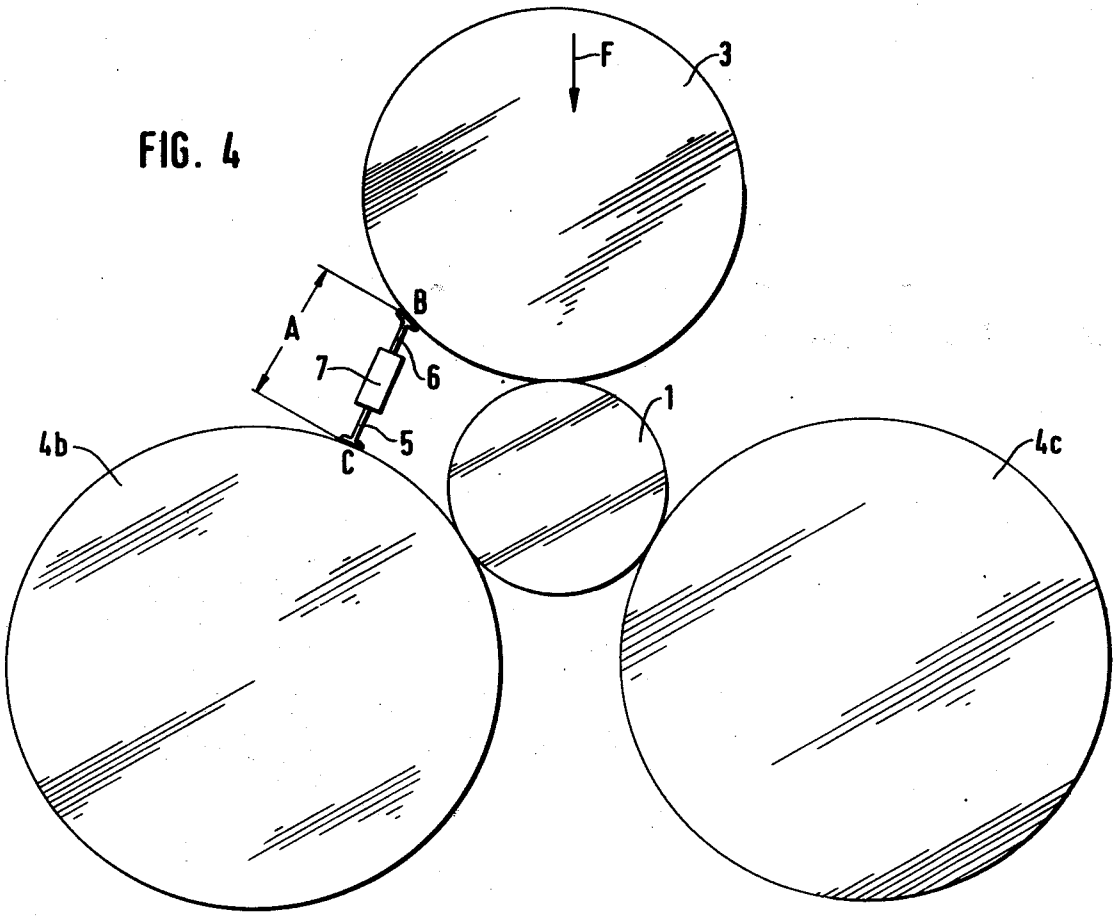
FIG. 4 schematically illustrates an arrangement which includes one working roll and two support rolls.

FIG. 4 schematically illustrates a modified arrangement in which two support rolls 4*b* and 4*c*, rotatable about fixed axes, are provided to support the workpiece 1 and only a single working roll is used which is movable in the direction of the arrow F toward the workpiece 1 to press the latter against the peripheral surfaces of the support rolls 4*b* and 4*c*. In this case the measuring device is arranged between the working roll 3 and one of the support rolls which, as shown in FIG. 4, may be the support roll 4*b*, to thus measure a corresponding distance A. In this embodiment the points B and C can be defined as the intersection points between a predetermined straight line with the peripheral surfaces of the rolls 3 and 4*b*.

The modification with two working rolls has the advantage that the above-mentioned errors resulting from the bending of the rolls, etc., can be essentially compensated. Since the rolls are moved towards each other, it can be assumed under the premise that the center line of the workpice during the rolling does not essentially move away from a line connecting the axes of the two rolls, that the pressure of the workpiece onto the supporting roll 4 does not change essentially. That is, the influence of the mentioned errors depends on the magnitude of the angle $\phi$, the apex of which is located at the center line of the workpiece and the legs of which pass through the center lines of the working rolls. This error may be disregarded if the magnitude of the angle $\phi$ is in the neighborhood of 180°, since in this case the error is essentially effective in the direction of movement of the movable working roll.

The magnitude of values for the angle $\phi$ at different working conditions can be calculated according to the formula $C_1(\phi)-C_2(\phi)$ is smaller than $\beta$, wherein $C_1(\phi)$ designates the distance between the center lines of the working rolls at practically pressureless contact with the workpiece, $C_2(\phi)$ the value at working pressure, and $\beta$ the maximum permissible error in the position of the peripheral surfaces of the working rolls 2 and 3 relative to each other. The angle $\phi$ can thereby of course not be greater than 180°.

Figure 2:
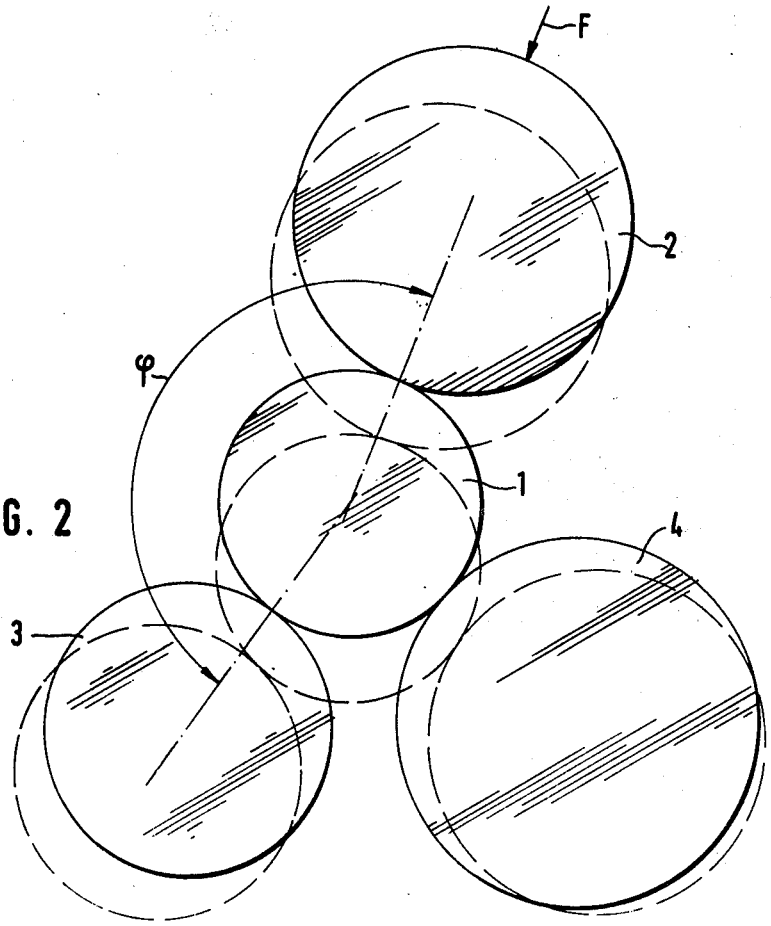
FIG. 2 schematically illustrates an arrangement in which the working rolls are arranged under an angle $\phi$.

This relationship is schematically indicated in FIG. 2 in which the various rolls shown in full lines illustrate the position these rolls would have if a workpiece having a diameter corresponding to the desired finished diameter would be placed between the rolls so that a further rolling down of the workpiece would not be necessary any longer, that is the various rolls contact only the peripheral surface of the workpiece without imparting pressure thereon. If now the next workpiece is placed between the rolls which has a diameter greater than the desired finished diameter, then the workpiece has to be rolled down to the desired finished diameter. The therefore necessary force will cause an elastic deformation of the various elements of the rolling apparatus. If for instance the roll 2 shown in FIG. 2 is moved toward the workpiece in order to reduce the initial workpiece diameter to the desired finished diameter, then the roll 3 as well as the support roll 4 will be elastically deformed, and the various positions of the rolls shown in dotted lines indicate the positions thereof when the workpiece 1 is finally rolled down to the desired finished diameter. As will be evident the angle $\phi$ will change depending on the initial diameter of the workpiece and the structure of the material of the workpiece and a change of this angle will result in a measuring error. The magnitude of this measurement error is evidently directly dependent on the angle $\phi$ and this magnitude of the error should not increase beyond a predetermined value.

It has been ascertained that measurement carried out in the above-mentioned manner permit to establish exactly the actual position of the rolls and therewith also the diameter of the workpiece. It is therefore possible to provide at a stationarily arranged measuring device, or in a measuring device which is only movable parallel to the connection line of the two feelers, a direct calibration of the measuring device, whereby an adjustment of the position of the measuring device will become only necessary after an essential wear of the rolls.

While the measurement of the actual dimension of the gap between the rolls is the basis of the method according to the present invention, it is further essential for the invention that the speed of movement of the working rolls toward each other should not surpass a predetermined value. According to the present invention this speed should not be greater than 0.1 millimeter per revolution of the workpiece.

It has also been established that not only the speed at which the working rolls are moved towards each other influences the exact result obtainable from the method, but that it is also advantageous to move the rolls away from the workpiece, after the latter has been rolled down to the finished diameter, with substantially the same speed of 0.1 mm per revolution of the workpiece during pressure engagement of the rolls with the workpiece. In fact, it has been established that it is advantageous to initiate the return movement of the rolls only, after the workpiece having been rolled down to the desired diameter, has made at least one revolution.

The reason for the above-mentioned features of the present invention may be seen in that during the rolling operation a material wave resulting from an elastic, as well as from a plastic deformation will be created at the engaging portions between rolls and workpiece, which has to be reduced during the last phase of the rolling process at which the rolling pressure is reduced, in order to obtain a closer tolerance at the finished workpiece. For this reason it is also advantageous to increasingly reduce the speed of movement of the rolls toward each other and to carry out the return movement of the rolls with increasing acceleration.

For this purpose a reversing switch 8 and a speed regulator 9 may be connected in circuit with the measuring device 7 and the means F for moving the roll 3 towards the roll 2, as schematically illustrated in FIG. 3. Such a reversing switch and speed regulator are well known in the art and the specific construction thereof does not form part of the present invention and therefore the reversing switch and speed regulator are only schematically illustrated in FIG. 3.

It will be understood that each of the elements described above, or two or more together, may also find a useful application in order types of methods and apparatus for finish rolling workpieces of substantially circular cross-section to a selected diameter differing from the types described above.

While the invention has been illustrated and described as embodied in a method and apparatus for finish rolling workpieces of substantially circular cross-section to a selected diameter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for finish rolling workpieces of substantially circular cross-section to a selected diameter comprising the steps of engaging circumferentially spaced portions of the workpiece by rolls rotatable about their axes; driving at least one of the rolls for rotation about its axis; moving at least one of said rolls towards the other with a speed not exceeding 0.1 mm per revolution of the workpiece until the portions of the rolls engaging the workpiece have reached a predetermined distance from each other in accordance with the selected diameter of the finished workpiece; and determining reaching of said predetermined distance by measuring the distance of the peripheral surfaces of the rolls at only two points in the working region of the rolls spaced from the portions of said rolls engaging the workpiece.

2. A method as defined in claim 1, and supporting the workpiece on a peripheral surface portion thereof located intermediate the surface portions engaged by said rolls.

3. A method as defined in claim 1, wherein after said predetermined distance of the rolls from each other is reached, said distance is maintained at least during one revolution of the workpiece and subsequently thereto said rolls are initially moved away from each other with a speed not exceeding 0.1 mm per revolution of the workpiece.

4. A method as defined in claim 3, wherein the movement of said rolls is carried out with a varying speed.

5. A method as defined in claim 3, wherein the retracting speed of said at least one roll is accelerated.

6. A method as defined in claim 1, wherein the advancing speed of said at least one roller is retarded to a speed smaller than 0.1 mm per revolution of the workpiece.

7. In an apparatus for finish rolling workpieces of substantially circular cross-section to a selected diameter, a combination comprising two rolls arranged for engaging a workpiece at circumferentially spaced portions; means supporting said rolls turnable about their axis and at least one of said rolls movable normal to its axis toward the other of said two rolls; means for moving at least said one roll toward the other of said two rolls until the portions of the rolls engaging the workpiece has reached a predetermined distance from each other in accordance with a selected finished diameter of the workpiece; measuring means having a pair of feelers engaging peripheral portions of said rolls facing each other spaced from and adjacent the portions thereof engaged by said workpiece to established when said predetermined distance of said rolls from each other is reached; switch means connected to said measuring means for reversing movement of said at least one roll after said predetermined distance has been reached; and means connected between said measuring means and said moving means and cooperating with the latter for moving said at least one roll toward and respectively away from the other while in engagement with said workpiece with a speed not greater than 0.1 mm per revolution of the workpiece.

8. A combination as defined in claim 7, and including means intermediate said two rolls for supporting the workpiece.

9. A combination as defined in claim 8, wherein said support means comprise a third roll.

10. A combination as defined in claim 8, wherein said support means comprises a stationary member having an upper surface inclined toward one of said rolls and supporting the workpiece.

* * * * *